US010533336B2

(12) United States Patent
Klebanov

(10) Patent No.: US 10,533,336 B2
(45) Date of Patent: Jan. 14, 2020

(54) SELF-PROPELLED ROBOTIC SWIMMING POOL CLEANER WITH POWER-WASH ASSEMBLY FOR LIFTING DEBRIS FROM A SURFACE BENEATH THE POOL CLEANER

(71) Applicant: Aqua Products, Inc., Cedar Grove, NJ (US)

(72) Inventor: Aleksandr Klebanov, Bloomfield, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 198 days.

(21) Appl. No.: 15/559,225

(22) PCT Filed: Mar. 10, 2016

(86) PCT No.: PCT/US2016/021661
§ 371 (c)(1),
(2) Date: Sep. 18, 2017

(87) PCT Pub. No.: WO2016/153794
PCT Pub. Date: Sep. 29, 2016

(65) Prior Publication Data

US 2018/0073264 A1 Mar. 15, 2018

Related U.S. Application Data

(60) Provisional application No. 62/136,910, filed on Mar. 23, 2015.

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654; E04H 4/1663
(Continued)

(56) References Cited

U.S. PATENT DOCUMENTS 3,961,393 A 6/1976 Pansini
4,651,376 A 3/1987 Ford
(Continued)

OTHER PUBLICATIONS

International Search Report dated Jun. 24, 2016 in counterpart International Application PCT/US2016/021661.
(Continued)

*Primary Examiner* — Mark Spisich
(74) *Attorney, Agent, or Firm* — Kilpatrick Townsend & Stockton LLP; Dean W. Russell

(57) ABSTRACT

A robotic pool cleaner includes a housing having an inlet and a discharge port, and an interior chamber with a filter therein. Rotatably-mounted supports guide the cleaner along a pool surface. A water pump includes a drive shaft having a first end coupled to a propeller. The water pump draws water and debris from beneath the cleaner through the inlet, such that debris is retained by the filter and filtered water exits through the discharge port. A power-wash assembly includes a transmission for transferring rotational movement from the pump drive shaft to a drive shaft of a centrifugal pump. The centrifugal pump has an inlet in fluid communication with filtered water from the interior chamber and an outlet in fluid communication with a nozzle positioned beneath the housing to discharge filtered water in a water jet to dislodge and lift debris from the surface of the pool.

13 Claims, 13 Drawing Sheets

(58) Field of Classification Search
USPC ..... 15/1.7; 210/167.1, 167.15–167.17
See application file for complete search history.

(56) References Cited

U.S. PATENT DOCUMENTS

| | | | |
|---|---|---|---|
| 4,835,809 | A | 6/1989 | Roumagnac |
| 4,920,599 | A | 5/1990 | Rief |
| 5,312,044 | A | 5/1994 | Eaton |
| 5,336,403 | A | 8/1994 | Marbach |
| 5,507,058 | A | 4/1996 | Minami et al. |
| 5,542,141 | A | 8/1996 | Albright |
| 5,706,539 | A | 1/1998 | Fukuda |
| 6,094,764 | A | 8/2000 | Veloskey et al. |
| 6,782,578 | B1 | 8/2004 | Rief et al. |
| 6,842,931 | B2 | 1/2005 | Porat et al. |
| 7,039,980 | B2 | 5/2006 | Van Der Meyden et al. |
| 7,060,182 | B2 | 6/2006 | Erlich et al. |
| 7,117,554 | B2 | 10/2006 | Pichon |
| 7,162,763 | B2 | 1/2007 | Henkin et al. |
| 7,213,287 | B2 | 5/2007 | Hui |
| 7,316,751 | B2 | 1/2008 | Horvath et al. |
| 7,537,691 | B2 | 5/2009 | Reid |
| 7,690,066 | B2 | 4/2010 | Stoltz et al. |
| 7,805,792 | B2 | 10/2010 | Roumagnac |
| 8,118,241 | B2 | 2/2012 | Gardner et al. |
| 8,307,485 | B2 | 11/2012 | Sumonthee |
| 8,434,182 | B2 | 5/2013 | Horvath et al. |
| 8,555,445 | B2 | 10/2013 | Fu et al. |
| 8,595,880 | B2 | 12/2013 | Pichon et al. |
| 8,615,836 | B2 | 12/2013 | Pichon et al. |
| 8,627,532 | B2 | 1/2014 | Hui |
| 8,689,439 | B2 | 4/2014 | Pfouts et al. |
| 8,696,821 | B2 | 4/2014 | Erlich et al. |
| 8,702,980 | B2 | 4/2014 | Mastio et al. |
| 8,763,187 | B2 | 7/2014 | Mastio et al. |
| 8,997,293 | B2 | 4/2015 | Pichon et al. |
| 9,062,473 | B2 * | 6/2015 | Erlich ..... B08B 9/08 |
| 9,116,436 | B2 | 8/2015 | Shin et al. |
| 2003/0182742 | A1 | 10/2003 | Wichman et al. |
| 2007/0067930 | A1 | 3/2007 | Garti |
| 2008/0235887 | A1 * | 10/2008 | Horvath ..... E04H 4/1654 15/1.7 |
| 2008/0236628 | A1 | 10/2008 | Horvath et al. |
| 2008/0244842 | A1 | 10/2008 | Lavabre et al. |
| 2010/0307545 | A1 | 12/2010 | Osaka et al. |
| 2011/0197932 | A1 | 8/2011 | Mastio et al. |
| 2012/0273004 | A1 | 11/2012 | Erlich et al. |
| 2013/0000677 | A1 | 1/2013 | Sumonthee |
| 2013/0092193 | A1 | 4/2013 | Porat et al. |
| 2013/0152316 | A1 | 6/2013 | Rief et al. |
| 2015/0273695 | A1 * | 10/2015 | Tamar ..... H02K 7/1823 320/108 |

OTHER PUBLICATIONS

International Preliminary Report on Patentability dated Sep. 26, 2017 in counterpart International Application PCT/US2016/021661.

* cited by examiner

SELF-PROPELLED ROBOTIC SWIMMING POOL CLEANER WITH POWER-WASH ASSEMBLY FOR LIFTING DEBRIS FROM A SURFACE BENEATH THE POOL CLEANER

CROSS-REFERENCE TO RELATED APPLICATION

This patent application claims the benefit under 35 U.S.C. § 371 to international application No. PCT/US2016/021661, filed on Mar. 10, 2016, which claims priority to US provisional application No. 62/136,910, filed Mar. 23, 2015, the contents of which are incorporated by reference herein in their entireties.

FIELD OF INVENTION

The invention relates to self-propelled robotic pool cleaners, and more specifically, to a method and apparatus for raising and capturing dirt and debris from the surface beneath the pool cleaner for entrainment by an internal filter of the cleaner.

BACKGROUND OF INVENTION

A general problem of effectively and efficiently cleaning the bottom surface of a pool exists where dirt and debris is heavy and/or when the pool has not been regularly cleaned. The movement of water through the inlet ports formed in the bottom or baseplate of the pool cleaner may not be sufficient to create the required turbulence at the surface to disturb and lift the dirt and debris into suspension so that it can be drawn into the water inlet port.

To address this problem, self-propelled swimming pool cleaners have been equipped with nozzles which discharge pressurized streams of water (i.e., water jets) that are directed at, and stir up debris on the surface of a pool beneath the pool cleaner. For example, commonly assigned U.S. Pat. No. 7,316,751 addresses this problem and discloses a method of lifting dirt and debris off the surface beneath the pool cleaner by discharging a pressurized stream of water at the pool surface beneath the cleaner via one or more directional cleaning water jet nozzles. Debris resting on the pool surface that is contacted by the pressurized stream is lifted into suspension beneath the cleaner and the water and suspended debris is drawn through the water inlet port in the base and is subsequently captured by the cleaner's filter or an external filter that is remote from the cleaner.

Commonly assigned U.S. Pat. No. 8,434,182 discloses a cleaning apparatus that utilizes a reversible jet drive valve to direct a propulsion water jet stream from a pump through a discharge conduit to thereby propel the cleaner along the surface of the pool. The jet drive valve additionally includes a pair of opposing ports in fluid communication with one or more lengths of tubing to deliver pressurized water to one or more nozzles mounted at opposing ends of the housing. The one or more nozzles discharge water jets towards the surface to stir up dirt and debris on the surface of the pool beneath the cleaner. Alternatively, a propeller pump and a centrifugal pump functioning as an impeller are both mounted coaxially along a single drive shaft of an electric motor. The centrifugal pump provides the pressurized water jet stream, via tubing, to nozzles mounted at the front end of the housing for stirring up dirt and debris on the surface of the pool beneath the cleaner.

In addition, commonly assigned published application US 20130092193 similarly discloses the propeller pump and a centrifugal pump functioning as an impeller which are both mounted coaxially along a single drive shaft of an electric motor to provide pressurized water, via tubing, to a cleaning apparatus base having at least one water inlet port and a transversely positioned conduit having a plurality of outlet openings. The outlet openings are spaced apart and discharge pressurized streams of water beneath the base in a direction generally normal to the longitudinal axis of the cleaner. The pressurized streams stir up dirt and debris on the surface of the pool beneath the cleaner and the debris is drawn into the cleaner through the water inlet port.

The utilization of pressurized streams of water directed under the base of the cleaner have been effective to raise and draw the dirt and debris into the cleaner for filtering has been very effective. However, the coaxial mounting of the centrifugal pump directly on the drive shaft of the electric motor produces a high rotational rate which can lead to reducing the useful life of the centrifugal pump and the inconvenience and expense of its replacement.

SUMMARY OF THE INVENTION

In one embodiment, a robotic pool cleaner for cleaning a surface of a pool includes: a housing having an upper portion disposed over a base to define an interior chamber therein; the base includes at least one water inlet and the upper portion having at least one water discharge port; rotatably-mounted supports support and guide the cleaner along the pool surface; a filter assembly for filtering water drawn through the at least one water inlet; a first water pump comprising a drive shaft having a first end coupled to a propeller, the water pump drawing water and debris from beneath the cleaner through the at least one inlet, the debris being retained by the filter assembly and the filtered water being discharged through the at least one water discharge port; and a power wash assembly including a transmission assembly for transferring rotational movement from the drive shaft of the water pump to a drive shaft of a second water pump, the second water pump being a centrifugal pump having an inlet in fluid communication with filtered water from the interior of the housing and an outlet in fluid communication with at least one nozzle positioned beneath the base that is directed towards the pool surface beneath the cleaner and which discharges filtered water in the form of a water jet to dislodge and lift debris from the surface of the pool.

In one aspect, the transmission assembly includes: a first pulley coupled to the drive shaft of the first water pump; a second pulley coupled to the drive shaft of the centrifugal pump; and a drive belt wrapped around the first and second pulleys. In another aspect, the drive belt is an O-ring.

In still another aspect, the first and second pulleys have the same diameter. Alternatively, the diameter of the first pulley is greater than the diameter of the second pulley, or in yet another aspect the first pulley is less than the diameter of the second pulley.

In one aspect, the centrifugal pump comprises: a circular pump housing having central axis; and an impeller mounted to a rotable impeller shaft which extends along the central axis of the pump housing.

In another aspect, the second pulley is coupled to the impeller shaft.

In yet another aspect, the second pulley is mounted on a first end of the impeller shaft and the impeller is mounted on a second opposing end of the impeller shaft.

In still another aspect, the impeller comprises a plurality of linearly-shaped blades directed radially outward from the impeller shaft.

In another embodiment, a method for cleaning a surface of a pool with a robotic self-propelled pool cleaner including a housing including an upper portion disposed over a base to define an interior chamber therein, the base including a water inlet and the upper portion having a water discharge port; rotatably-mounted supports supporting and guiding the cleaner along the pool surface; a filter assembly; a first water pump having an electric motor; and a second water pump that is a centrifugal pump, the method including: activating the first water pump and moving the cleaner along a surface of the pool; drawing water and debris from beneath the cleaner through the water inlet, retaining the debris in the filter assembly, and discharging filtered water from the interior chamber through a water discharge port; activating the centrifugal pump from the water pump via a transmission assembly; drawing filtered water from the interior chamber through a centrifugal pump inlet provided along a central axis of the centrifugal pump; and discharging filtered water through an outlet nozzle positioned beneath the base, the nozzle being directed towards the pool surface beneath the cleaner and which discharges filtered water in the form of a water jet to dislodge and lift debris from the surface of the pool.

In an aspect, the method further comprises the step of directing the outlet nozzle towards the water inlet.

In another aspect, the method comprises the step of rotating the centrifugal pump at a different rotational rate of the electric motor. In yet another aspect, the electric motor includes a first pulley mounted to an end of a drive shaft, and the centrifugal pump includes an impeller shaft having a an impeller mounted to a first end and a second pulley mounted a second end, and the step of activating the centrifugal pump includes: rotating the first pulley mounted to the driveshaft of the electric motor; and rotating the second pulley mounted to the impeller shaft of the centrifugal pump via one of a drive belt and an O-ring.

In still another aspect, the method includes the step of mounting the second pulley with a diameter that is different than the diameter of the first pulley.

Figure 1:
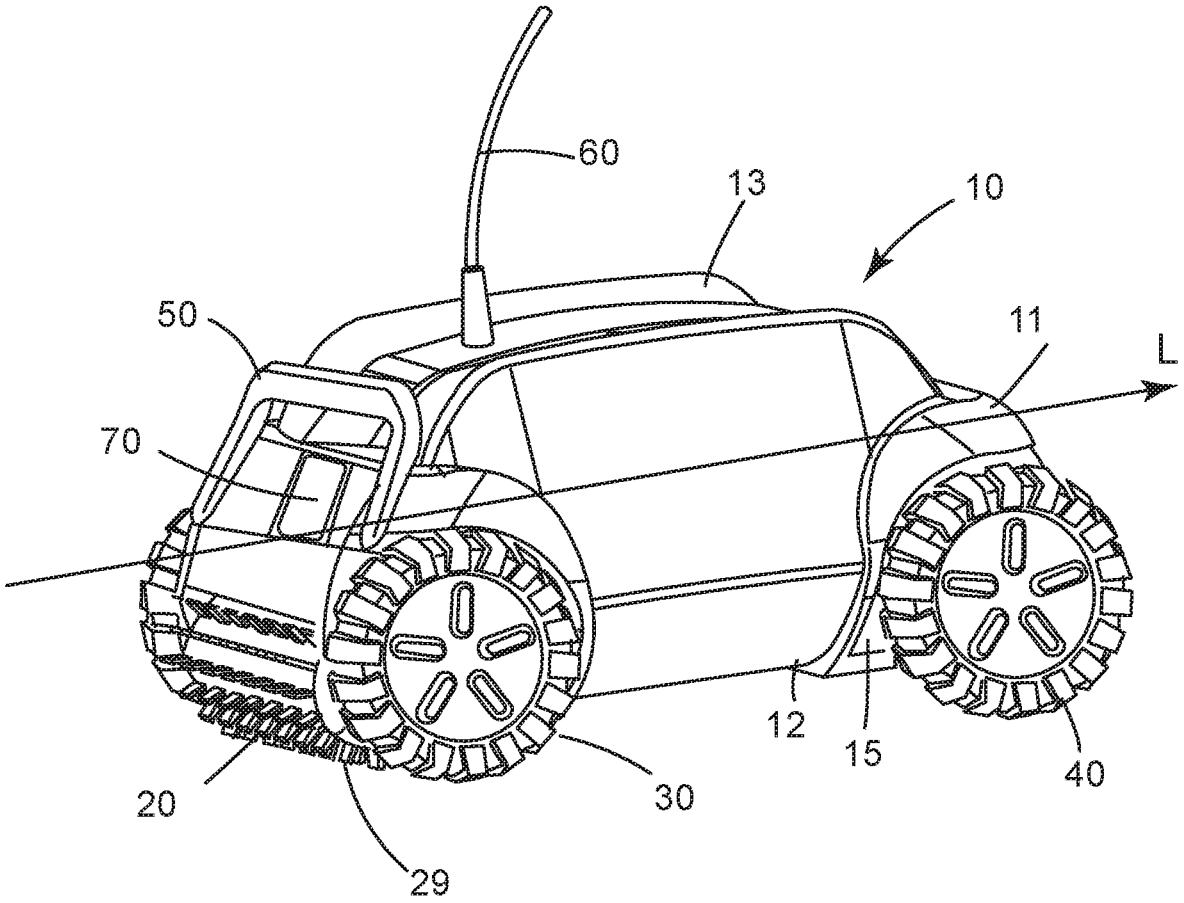
FIG. 1 is a top, front right side perspective view of a self-propelled robotic pool cleaner having an interior chamber with a dual propeller motor and a power wash assembly of the present invention.

In the following description of the invention, identical reference numerals have been used, when appropriate, to designate the same or similar elements that are common to the figures. Further, unless specifically stated otherwise, the features shown in the figures are not drawn to scale, but are shown for illustrative purposes only.

For purposes of the following description of the invention, terms connoting direction and positioning of components are defined as follows: the longitudinal axis of the cleaner is defined as extending centrally through the cleaner in the direction of movement; movement of the cleaner in a forward direction is the direction that the cleaner is presently being propelled or driven along its cleaning path; movement of the cleaner in a reverse direction is a direction that is opposite to the forward direction along the cleaning path; the front of the cleaner is defined as the portion of the cleaner that is generally perpendicular to the longitudinal axis as the cleaner travels in the forward direction of movement along its cleaning path; the "back" or "rear" of the cleaner is defined as the portion of the cleaner that is generally perpendicular to the longitudinal axis and opposite the forward direction of movement as the cleaner travels along its cleaning path. The front and rear portions of the cleaner are reversed as the cleaner is propelled in opposite directions; and the terms "top", "bottom", "upper" and "lower" are adjectives that denote different cleaner components, as well as define the relative positioning of such components with respect to a vertical plane extending centrally through the housing cover and base of the cleaner.

DETAILED DESCRIPTION OF THE INVENTION

The invention is directed to a method, apparatus and system for controlling the flow of one or more pressurized streams of water (i.e., water jets) that are directed towards the bottom surface of the pool beneath the cleaner. The pressurized water jets lift up and suspend dirt and debris in the water beneath the cleaner so that the debris (and water) can be drawn into one or more water inlet ports formed along the bottom of the cleaner for filtering. The dirt and debris is captured by a filter of the cleaner and the filtered water is discharged from the cleaner back into the swimming pool. In one embodiment, the filtered water is discharged so as to propel the cleaner in a forward direction of movement. A more detailed description of pool cleaners that implements opposing water jets to propel the cleaner in forward and reverse directions is provided in commonly assigned U.S. Pat. No. 7,900,308 and published application US 20130146106, the contents of which are incorporated by reference herein in their entireties.

Figure 2:
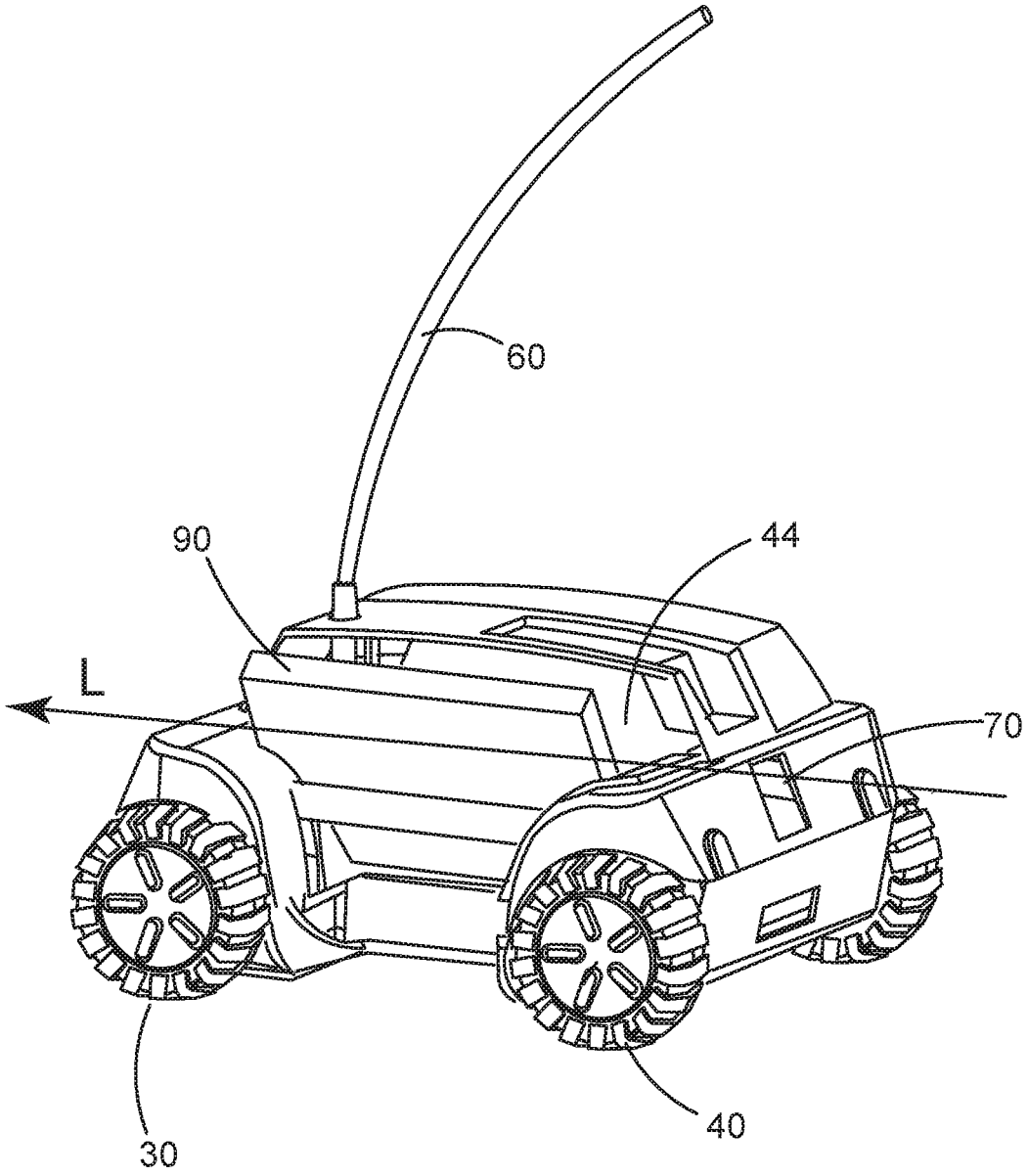
FIG. 2 is a top, rear right side perspective view of the pool cleaner of FIG. 1 illustrating a filter assembly mounted in the interior chamber of the cleaner.

Referring to FIGS. 1-5, an illustrative self-propelled robotic pool cleaner 10 that is suitable for implementing the power wash method and system assembly of the present invention is shown. Referring to FIGS. 1 and 2, the pool cleaner 10 includes a housing 11 having a bottom portion or base 12 and an upper portion which can form a cover 13 above the base 12. The base 12 and upper portion and/or cover 13 collectively define an interior chamber 44 in which a propulsion drive motor assembly 78 (FIG. 3), a filter 90 (FIG. 2), the power wash assembly 100 (FIG. 3) of the present invention, electronic controllers (not shown), and other cleaner assemblies and components are housed.

In one embodiment, the housing cover 13 is removably secured to the base 12 to define the interior chamber 44. The cover 13 and base 12 are removably fastened with one or more fasteners such as a clasp, latch, spring clip, bolt or other well-known and conventional fasteners. A gasket or other seal (not shown) can be inserted between the base 12 and cover 13 to prevent water flowing therebetween into and out of the interior chamber 44. The cover 13 and base 12 are preferably made of a polymer, such as polyvinylchloride (PVC), polypropylene, among other well-known thermoplastic materials, aluminum and/or alloys thereof, and/or combinations thereof, and/or other corrosion resistant, water impermeable materials.

The cleaner 10 is generally configured to be neutrally buoyant when submerged in the water. The housing 11 can include ballast and/or floats (not shown) to achieve a desired neutral buoyancy of the cleaner. In one embodiment, an external handle of the cleaner can be fabricated from a foam-like material to assist with floatation while the cleaner is positioned vertically on the side wall and is performing a cleaning operation along the water line of the pool. In another embodiment, the rear end of the cleaner can include a ballast material while the front end includes a float to assist the cleaner when climbing a vertical sidewall of the pool.

The cleaner includes a discharge conduit or port 70 that is formed in the upper portion of the housing 11 and which can be directed normally or at an acute angle with respect to the surface beneath the cleaner. Since the cleaner is generally neutrally buoyant, the downward thrust from a water jet being discharged from the discharge port 70 helps to stabilize and maintain the cleaner 10 on the surface being cleaned. As illustratively shown in FIGS. 1 and 2, a discharge conduit or port 70 is provided at the opposing ends (front and rear) and preferably centrally positioned on the longitudinal axis "L" of the cleaner 10.

Figure 6:
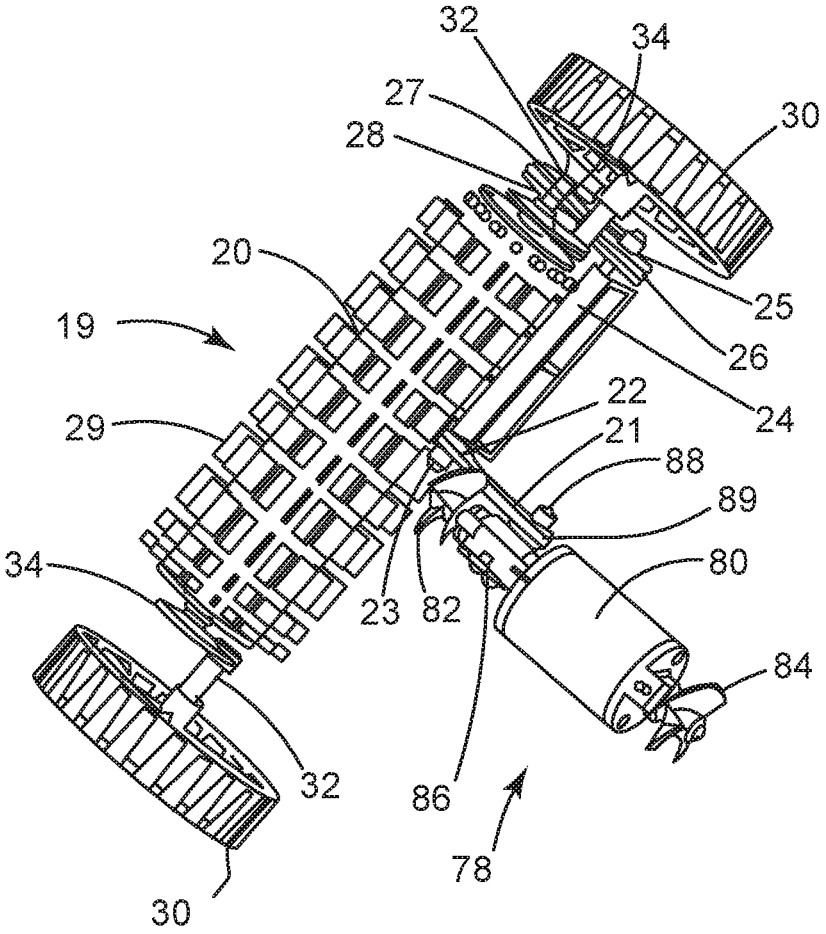
FIG. 6 is a bottom isometric view of the dual propeller motor and the brush assembly of the cleaner of FIG. 1.

The robotic pool cleaner 10 includes rotationally-mounted supports which are coupled to the housing 11 for moving and guiding the cleaner 10 over the submerged surface of the swimming pool or tank. The rotationally-mounted supports are illustratively formed by wheels 30 and 40 mounted on axles 32 (FIG. 6). A person of ordinary skill in the art will appreciate that the wheels 30, 40 are not considered limiting and are disclosed herein for illustrative purposes only. For example, the rotationally-mounted supports can be or include one or more tracks, rollers, casters and the like. As illustrated, the axles of the rotationally-mounted supports can be mounted transverse to the longitudinal axis L of the cleaner 10. In other embodiments, the mounting axles are movable to facilitate movement of the cleaner 10 in an arcuate path.

Figure 3:
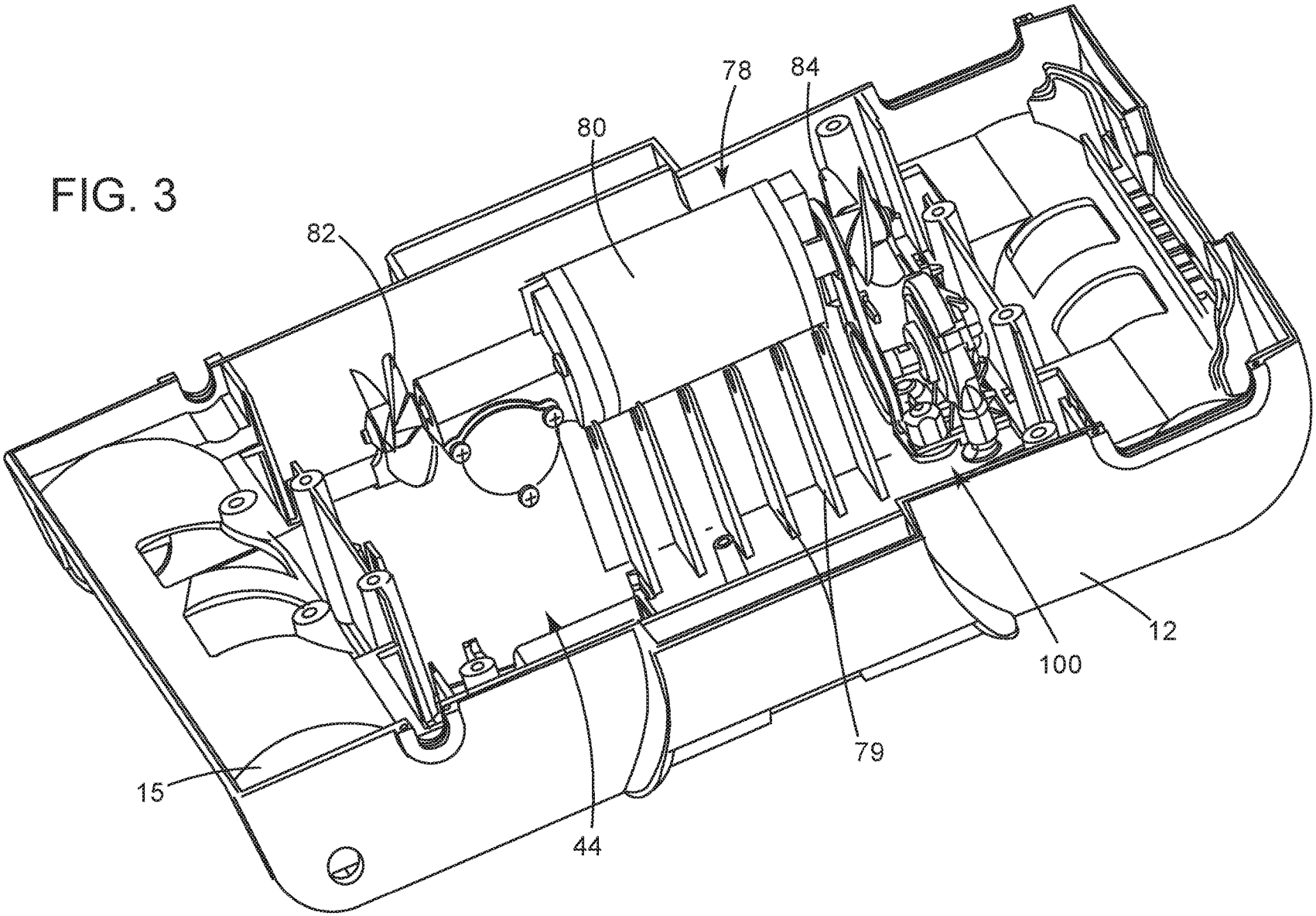
FIG. 3 is a top, right side isometric view of a base forming a lower portion of the interior chamber of the cleaner of FIG. 1 illustrating the dual propeller motor and the power wash assembly mounted therein.
Figure 4:
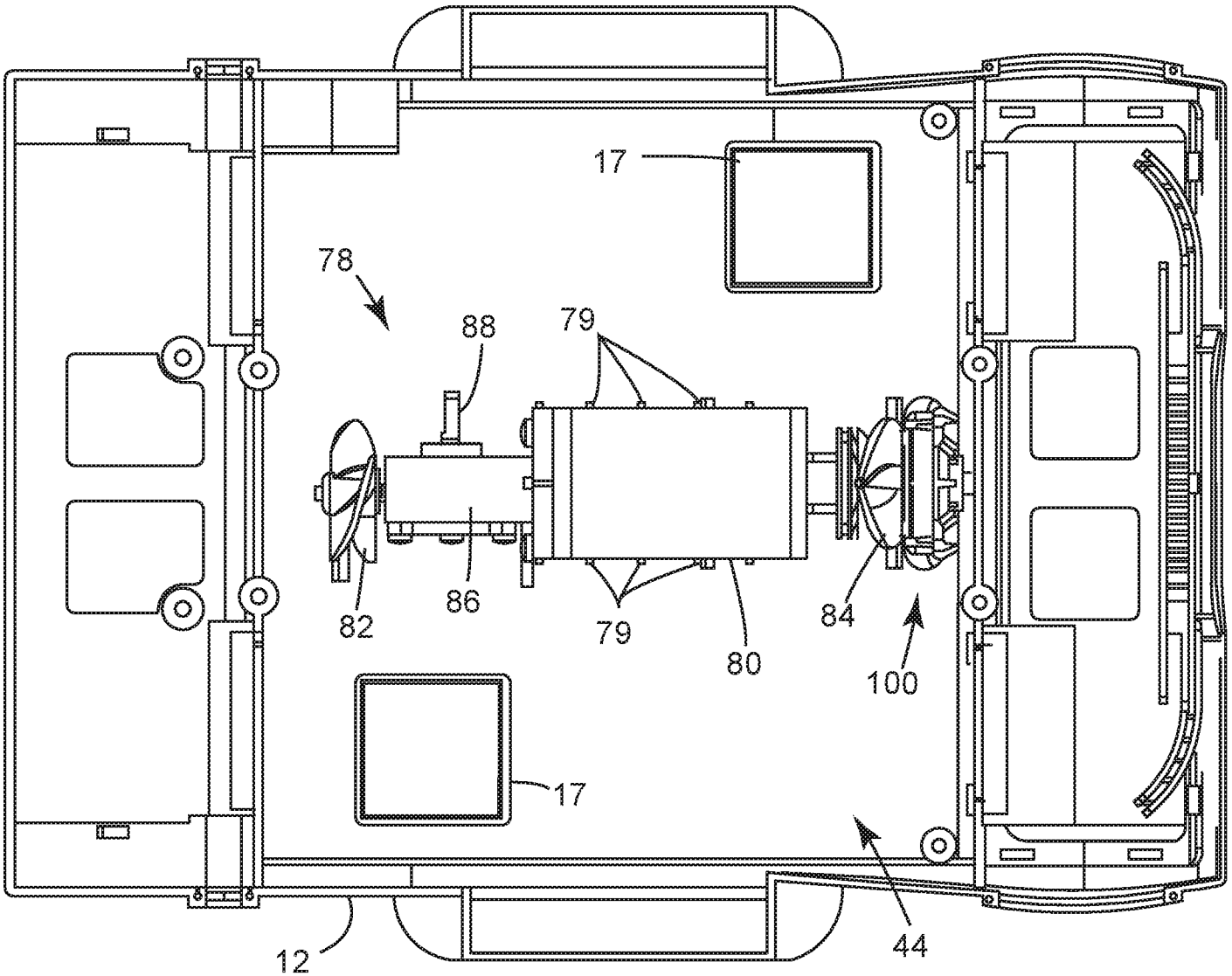
FIG. 4 is a top plan view of the base of the cleaner of FIG. 1 illustrating the dual propeller motor and the power wash assembly mounted therein.

Referring now to FIGS. 3, 4 and 6, the cleaner 10 is propelled by a dual propeller electric motor assembly 78 that produces the embodiment of jet of filtered water that is discharged through a water jet discharge conduit or port 70 (FIG. 1) formed in the housing 11. The dual propeller motor eliminates the need for providing additional drive motors and/or gear trains as is commonly implemented in the prior art to directly engage and rotate one or more of the supporting wheels or tracks.

Control means (not shown) can be provided to steer and/or periodically reverse the direction of movement while performing a cleaning program, as well as to assure that the cleaner does not become immobilized, e.g., by an obstacle in the pool. If, for example, the pool cleaner does not change its orientation with respect to the bottom or sidewall as indicated by a signal from an on-board sensor (e.g., mercury switch) indicating that such transition has occurred during the prescribed period (e.g., two minutes), a control circuit will automatically reverse the polarity of the electric motor 80 to change the direction of movement in order to permit the cleaner to move away from the obstacle and resume its scanning pattern. Sensors, such as magnetic and infrared-responsive signaling devices can also be provided to change the direction of movement in response to prescribed conditions, e.g., absence of forward movement due to an obstacle. In addition, the control means can automatically steer the cleaner to the right or left while moving in either the forward or reverse direction. Power for the cleaner 10 is supplied by a buoyant electrical cable 60 attached to an external power source, such as an external power supply, a transformer or a remote battery contained in a floating housing at the surface of the pool, although such power sources are not to be considered as limiting and form no part of the invention.

Figure 5:
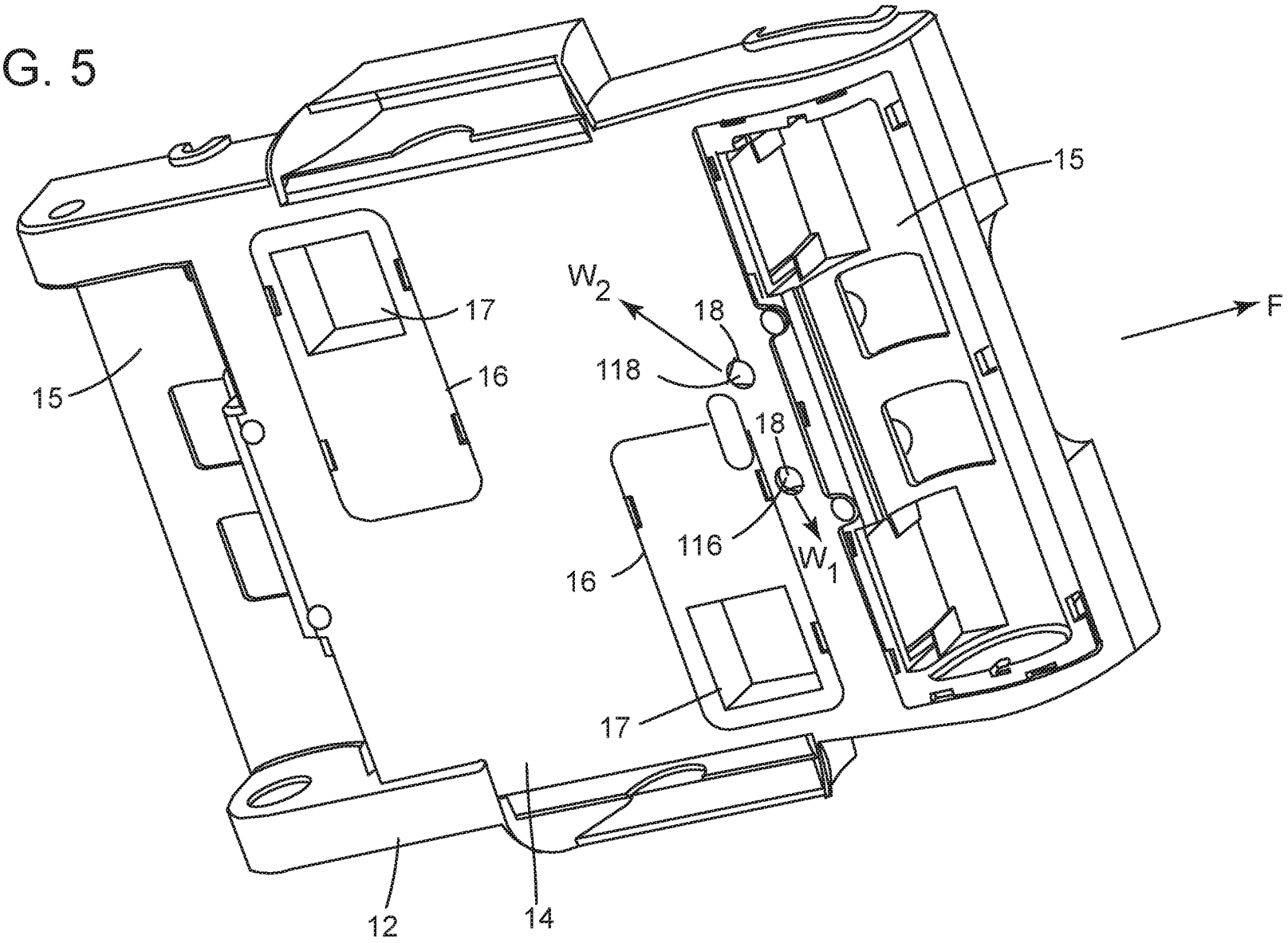
FIG. 5 is a bottom right side isometric view of the base of the cleaner of FIG. 1 illustrating at least one water inlet port and a brush well for mounting a brush assembly.

Referring now to FIGS. 4 and 5, the cleaner 10 includes at least one water inlet port 17 formed in the base 12. Referring to FIG. 5, the bottom surface of the base 12 preferably includes an upwardly sloped or curved portion 16 formed around each water inlet port 17 to help channel or otherwise direct the flow of debris and water beneath the cleaner into the water inlet port 17.

Referring now to FIG. 2, the cleaner 10 includes a filter assembly 90 that is mounted within the interior chamber 44 over the water inlet ports 17 of the base 12. The filter assembly 90 is illustratively shown as being a filter cartridge, although such configuration is not limiting. For example, the filter assembly can be a filter basket having a mesh screen, a filter bag, a filter canister, a perforated or mesh screen or any other well-known filtering device.

In particular, the filter is positioned over the water inlet ports 17 such that water and debris from beneath the cleaner that is drawn into the interior chamber is captured by the filter and the debris cannot escape. A cover, check valve or flap valve can be provided over each water inlet port 17 to prevent reverse flow of the debris back into the pool when the cleaner is powered down. The water and debris that is drawn into the cleaner via the inlet port 17 is filtered (i.e., retained) by the filter assembly 90 and the clean water that passes through the filter medium is discharged back into the pool through the one or more discharge ports 70.

As shown in FIGS. 1 and 2, the discharge conduit/port 70 is provided on the front and rear ends of the cleaner 10 and, preferably, the discharge conduits 70 are angled with respect to the surface below the cleaner. Referring to FIG. 1, when the filtered water is discharged through the left side discharge port 70 in the form of a pressurized water jet, the cleaner will move in a forward direction to the right. Similarly, referring to FIG. 2, when the filtered water is discharged through the right side discharge port 70 in the form of a pressurized water jet, the cleaner will move in a forward direction to the left. Thus, the filtered water jet produces a drive motive force for moving the cleaner. As well, the front and rear portions of the cleaner 10 alternate back and forth based on the forward direction of movement of the cleaner. As shown in the drawings, the water jet discharged from the discharge port 70 is at an angle "a" to the translational plane of movement of the cleaner 10 and produces a force vector component in a downward direction towards the leading wheels, as well as a translational force vector tending to move the cleaner across the surface being cleaned. The orientation of the discharged water jet can be varied to provide a downward component or force vector, lateral components, or a combination of such components or force vectors to complement the translational force. For a detailed understanding of implementing a water jet drive for moving the cleaner, the reader is directed to commonly assigned U.S. Pat. No. 6,412,133 and commonly assigned U.S. application Ser. No. 13/578,432, the content of which are incorporated by reference herein in their entireties.

Referring to FIGS. 3, 4 and 6, a water pump assembly 78 is mounted on a mounting structure 79 formed in the interior chamber 44 of the cleaner 10. The water pump assembly 78 illustratively includes an electric motor 80, a drive shaft 81, first a propeller 82 and a second propeller 84, in which the first and second propellers are mounted on opposing ends of the drive shaft 81. The electric motor 80 receives power from an external power supply via the electric cable 60. Rotation of at least one of the propellers 82, 84 causes the filtered water from the interior chamber 44 to flow an adjacent discharge port 70. The discharged filtered water creates a low water pressure environment within the interior chamber 44, which in turn induces water and debris from beneath the cleaner (which is at a higher pressure) to be drawn into the water inlet port 17 for filtering by the filter assembly and subsequent discharge through the discharge conduits 70.

The water pump assembly 78 is preferably mounted horizontally with respect to the base 12 to enhance flow of the filtered water through an adjacent discharge conduit 70. Preferably, both propellers rotate contemporaneously to expel the filtered water through one of the discharge ports 70. When the polarity of the electric motor is reversed, the electric motor and the propellers rotate in the opposite direction and the filtered water is expelled through the other discharge port 70 to reverse the direction of movement of the cleaner 10. Accordingly, the water pump assembly 78 causes the water to flow in and out of the cleaner 10 for purposes of filtering the water, as well as to propel the cleaner along the surface of the pool to be cleaned. Although the water pump is described as being a horizontally mounted dual propeller pump, such configuration is not limiting for purposes of the present invention. That is, a person of ordinary skill in the art will appreciate that other water pump assembly configurations may be implemented to practice the invention. For example, the water pump assembly can include a pair of water pumps with each pump having a propeller mounted to corresponding electric motor, a single propeller motor mounted horizontally, vertically or at an angle therebetween, and the like.

Referring to FIG. 6, the water pump assembly 78 can also be used to rotate a roller brush 20 of a brush assembly 19 which is positioned along the bottom of the base 12 to scrub the pool surface beneath the cleaner 10. As illustratively shown in the drawings, the brush assembly 19 comprises a roller brush 20 having a plurality of bristles or protruding members 29. The brush 20 can be made from molded polyvinyl chloride, expanded polymeric foam having a smooth surface and polymeric foam with a resilient textured surface, a ribbed solid polymer web that is formed into a cylindrical supporting surface, among other well-known roller brush materials.

The electric motor 80 includes a gear box 86 which translates the rotation of the electric motor 80 by 90° or some other angle and also reduces the number of rotations at a predetermined ratio. The gear box 86 has a takeoff spindle 88 which carries a first pulley 89 which transmits a rotational force to a gear train or preferably a drive belt system 21. The drive belt 21 in turn transmits this force to a second pulley 22 provided on a proximal end of a drive transfer shaft 23. The drive transfer shaft 23 can be supported by an elongated bushing 24. The drive transfer shaft 23 carries another (third) pulley 25 at its distal end which transmits the rotational force to a second drive belt 26. The second drive belt 26 is looped over a fourth pulley 27 which is free to rotate. The drive belt 26 frictionally engages the axle 28 of the roller brush 20. This facilitates slippage between the roller brush 20 and ultimately the electric motor 80, should the roller brush 20 encounter some type of obstacle like a large piece of debris on the surface being cleaned. This avoids the vehicle 10 becoming stalled by such obstacles and allows the vehicle 10 to pass over them. For a detailed understanding of a suitable brush assembly 19, the reader is directed to commonly assigned US application no. 20140137343, the content of which is incorporated by reference in its entirety. A person of ordinary skill in the art will appreciate that the brush assembly 19 is not considered limiting and is described herein for illustrative purposes only.

Referring to FIG. 5, the bottom view of the base is illustratively shown. The brush 20 driven by the electric motor 80 is installed in a brush well 15 which extends laterally across the bottom portion at one end of the cleaner 10. A non-driven or passive roller brush 20 can be installed in a brush well 15 which extends laterally across the opposite end of the bottom portion of the cleaner 10. In this embodiment, the power wash assembly 100 is mounted in the interior chamber 44 in board of, and proximate to the passive brush well 15.

Figure 7:
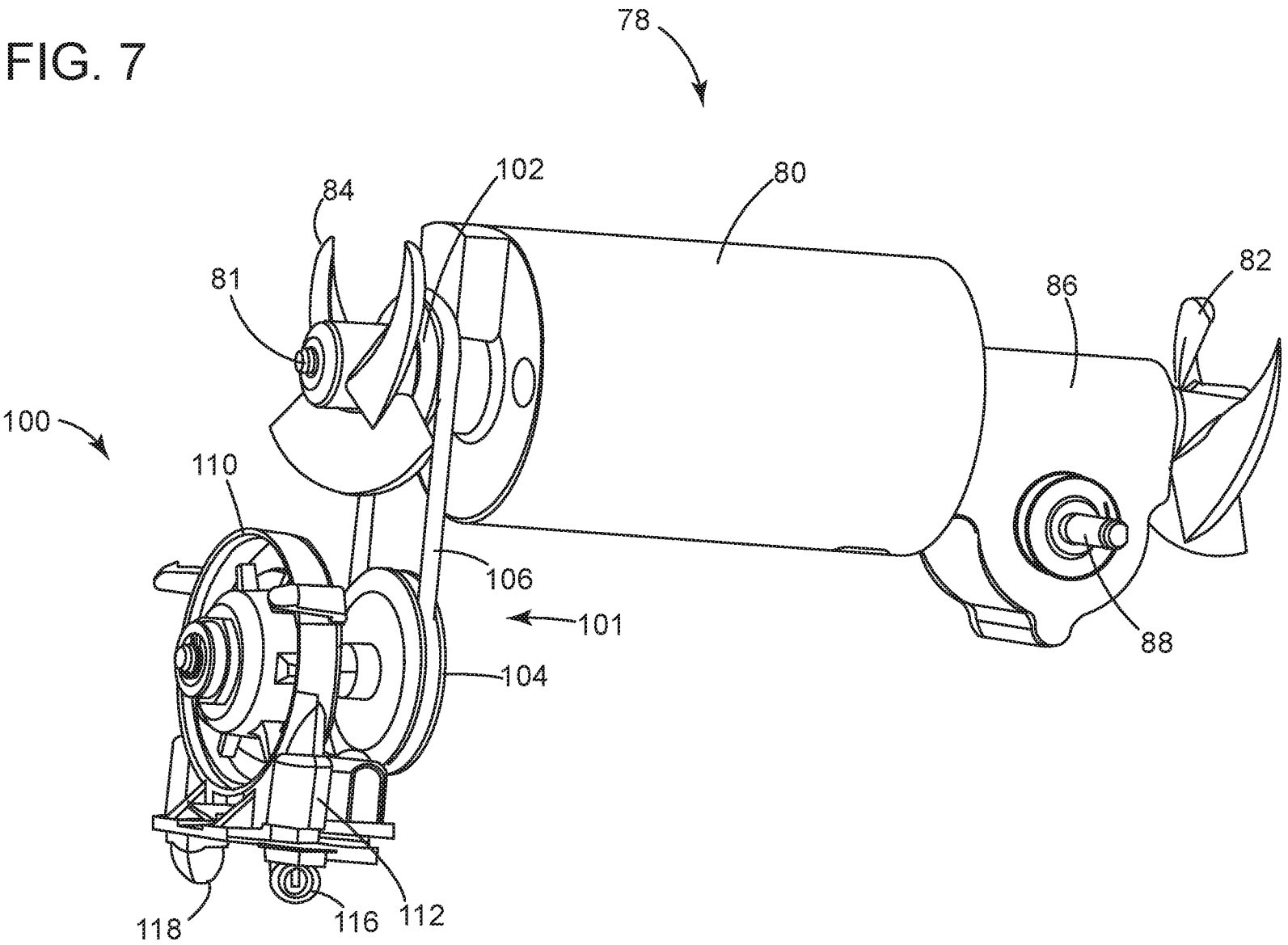
FIG. 7 is a left side isometric view of the dual propeller motor and the power wash assembly of FIG. 1.

Referring to FIGS. 3, 4 and 7, an embodiment of a power wash assembly 100 in accordance with the present invention is illustratively shown. The power wash assembly 100 is mounted to the interior surface of the base 12 and includes a transmission assembly 101, a centrifugal pump 110 in fluid communication with at least one nozzle directed towards the surface beneath the cleaner 10 for delivering a pressurized stream of filtered water from the centrifugal pump. The centrifugal pump 120 is rotated by the transmission assembly 101 which is rotated by drive belt connected to the drive shaft of the electric motor 80 by a belt and pulley system.

Figure 9:
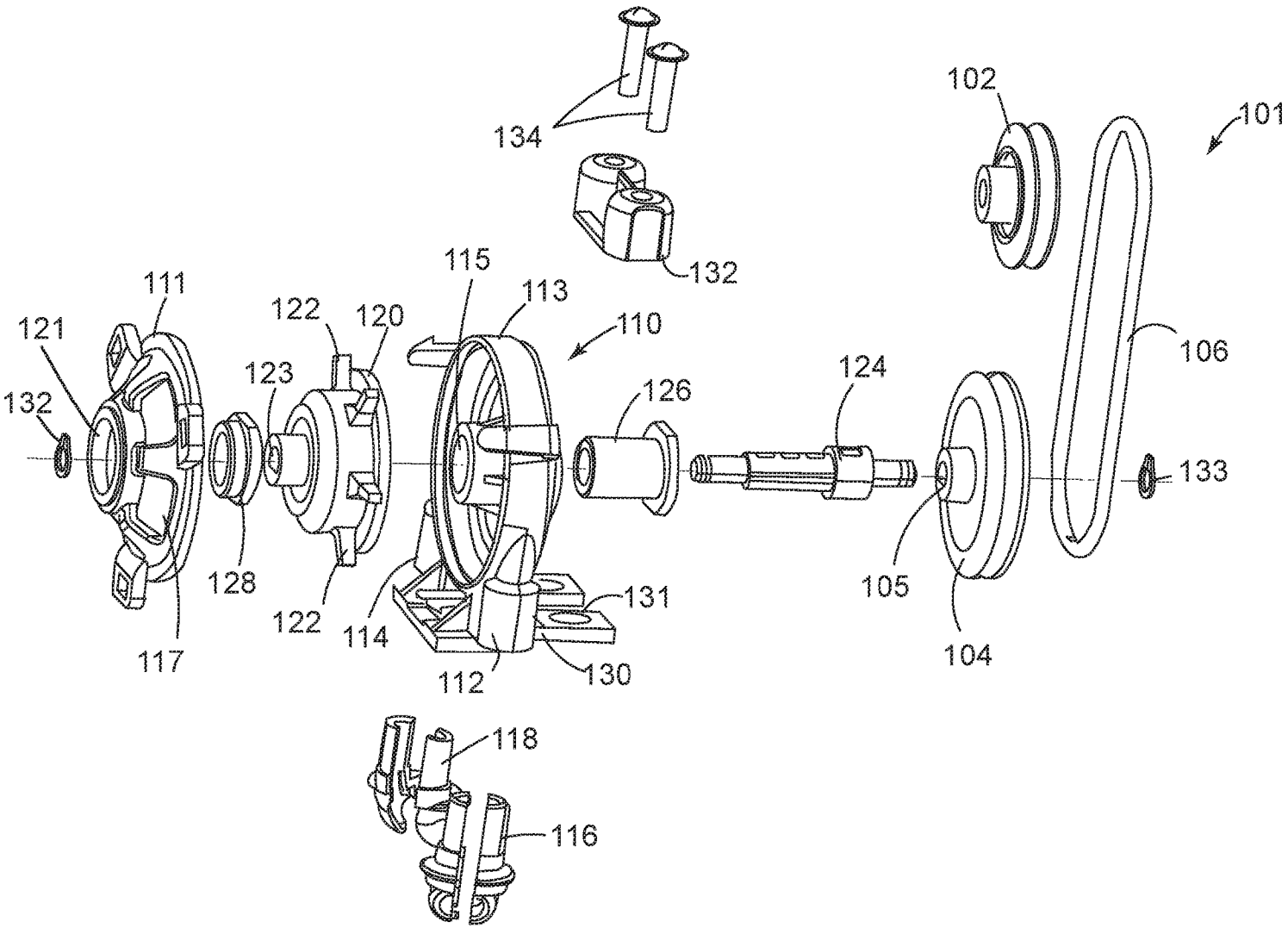
FIG. 9 is an exploded top, left-side perspective view of the power wash assembly of FIG. 1.

Referring to FIGS. 3 and 9, the centrifugal pump 110 comprises an impeller housing 113 and an impeller cover 111 in which an impeller 120 having a plurality of blades 122, and an impeller shaft 124 are mounted. The impeller housing 113 is preferably circular in shape and includes a mounting flange 130 having a plurality of orifices for securing the centrifugal pump 110 to the upper surface of the base 12 via one or more fasteners. As illustratively shown in the drawings, the centrifugal pump 110 is secured to the interior surface of the base 12 by a clasp 132 and a pair of fasteners (e.g., rivets or screws) 134 which extend through correspondingly dimensioned orifices 131 formed in the mounting flange 130. A person of ordinary skill in the art will appreciate that other fasteners can be utilized to removably secure the centrifugal pump 110 to the base 12 such as, for example, bolts, snaps or any other fastener suitable for attaching the centrifugal pump 110 to the base 12. It will also be understood that the pump can be secured at other positions and to other elements, including the cover.

The pump housing 113 includes a central orifice 115 through which the impeller shaft 124 extends coaxially therethrough. Preferably, the impeller shaft 124 is rotatably mounted in the central orifice 115 through one or more low friction bushings or bearings (e.g., nylon bushings) 126 to reduce frictional forces and power required to rotate the impeller shaft 124.

Figure 11:
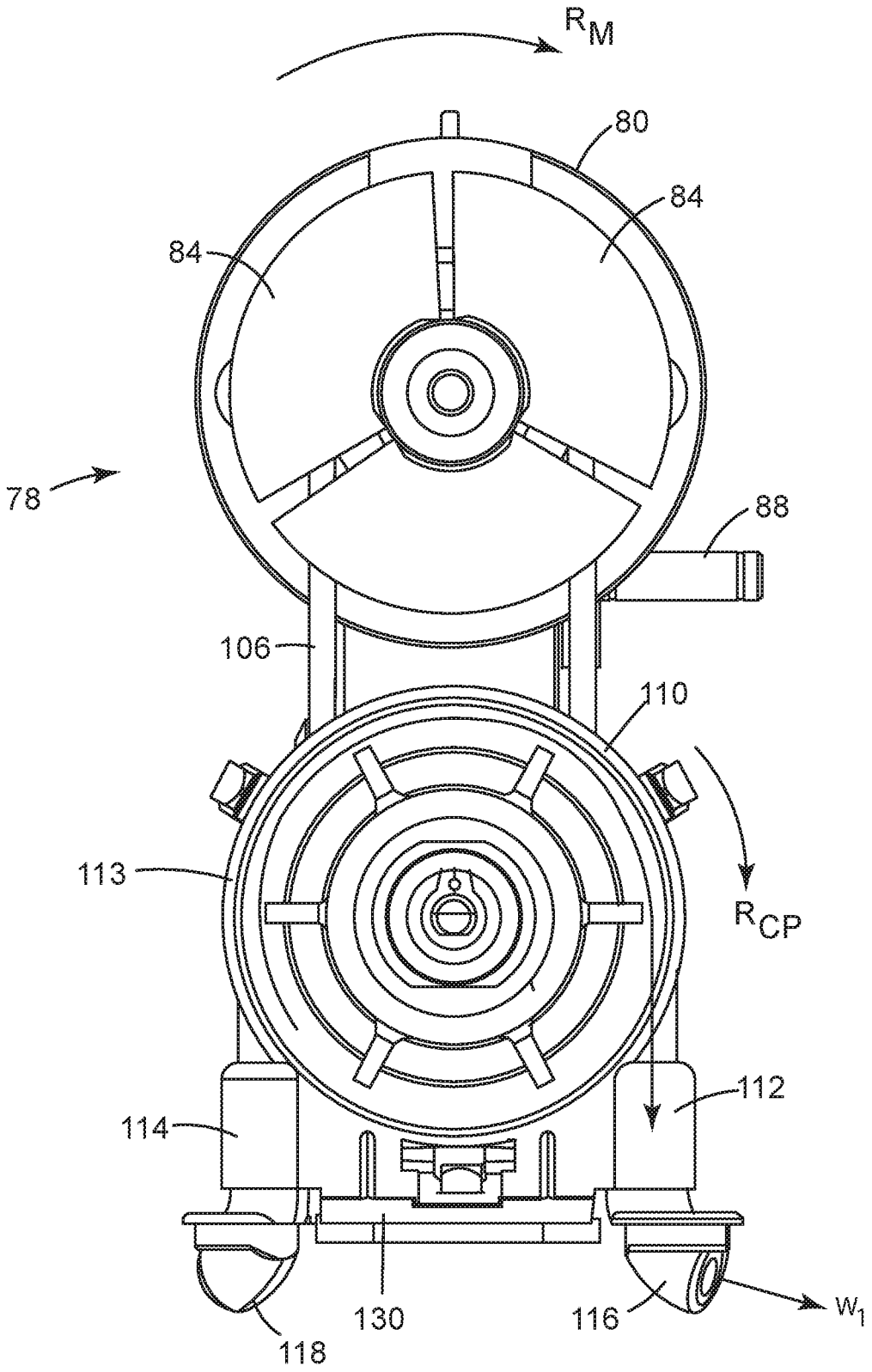
FIG. 11 is a front elevated view of the dual propeller motor and the power wash assembly of FIG. 1 illustrating a first water jet nozzle discharging a pressurized stream of water when the dual propeller motor is rotating in a clockwise direction.

The impeller 120 is similarly circular in shape and includes a central orifice which is dimensioned to receive a first end of the impeller shaft 124. Preferably, the first end of the shaft 124 and the central orifice 123 of the impeller 120 are keyed to prevent slippage therebetween. Referring to FIG. 11, the impeller includes a plurality of blades 122 which are preferably planar in shape and radiate outwardly from the central axis of the impeller 120. Although six blades are illustratively shown in FIG. 11, the number of blades is not limiting.

The pump housing 113 further includes an impeller cover 111 having a plurality of slots 117 which is positioned over and protects the front of the impeller 120. The impeller cover 111 can be attached to the housing 113 by clasps that snap fit together, clamps, fasteners and/or any other well-known fastening techniques. The housing cover 111 can include a central orifice 121 which is aligned with the central orifice 123 of the impeller 120. Optionally, a second bushing 128 is disposed about impeller shaft 124 along the front of the impeller 120 and includes a shoulder sized for insertion through the central orifice 121 of the impeller cover 111. The second bushing 128 can also be fabricated from nylon or a similar material and helps provide stability and prevent frictional binding between the housing cover 111 and the front end of the impeller 124. A retaining ring 132 or other fastener is provided about the terminal end of the impeller shaft 124 to secure the front of the impeller 120 and bushings 126, 128 to the shaft 124.

Figure 10:
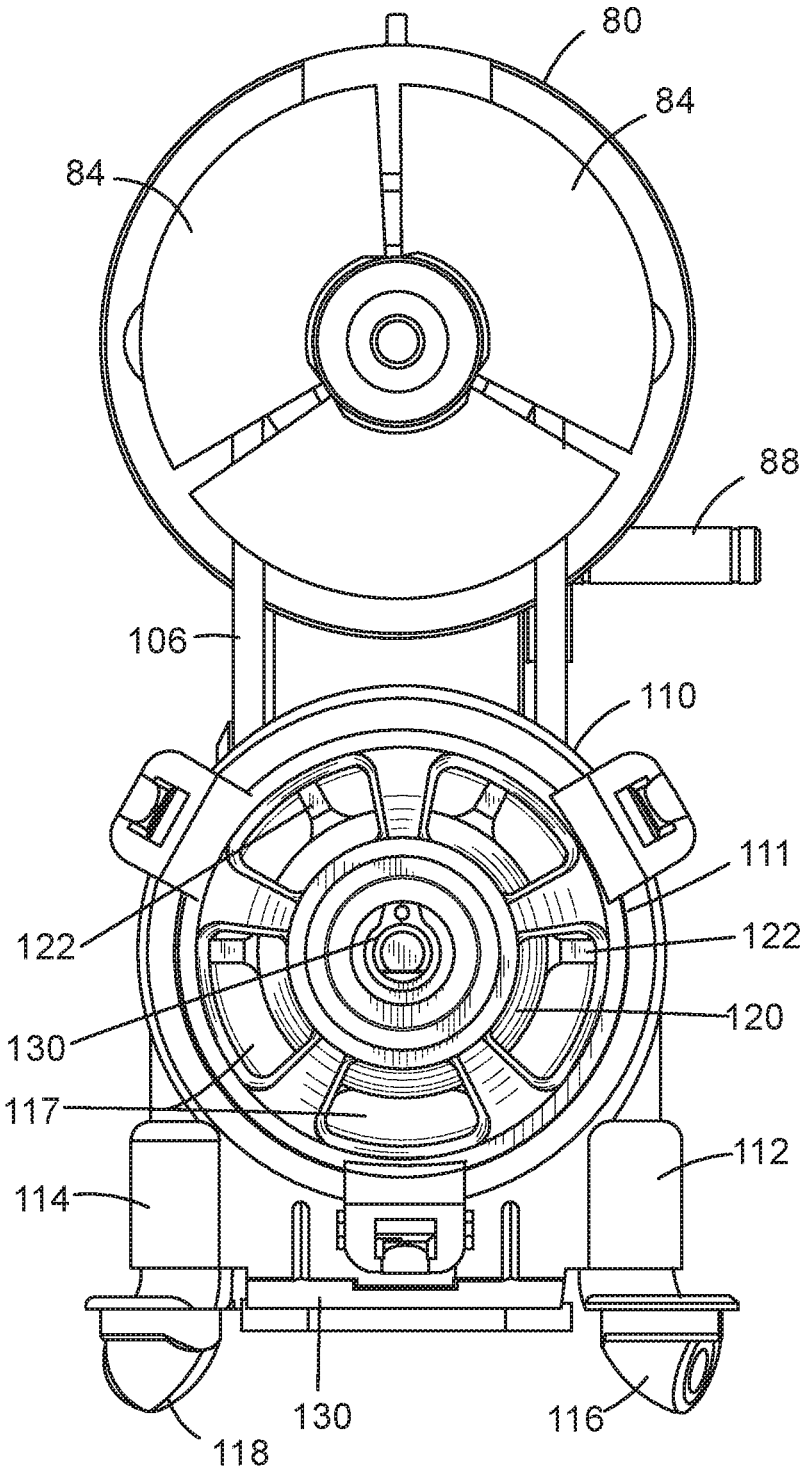
FIG. 10 is a front elevated view of the dual propeller motor and the power wash assembly of FIG. 1.

Referring now to FIG. 10, the pump housing 113 further includes a first water outlet 112 and a second water outlet 114. The first and second water outlets are circular in shape and are illustratively formed proximate the bottom portion of the housing adjacent to the housing mounting flange 130. The first nozzle 116 is in fluid communication with the first outlet 112 and the second nozzle 118 is in fluid communication with the second outlet 114. Although the centrifugal pump is discussed as having two outlets, the number of outlets is not considered limiting as one or more outlets can be provided to direct pressurized water to corresponding nozzles extending below the bottom surface of the cleaner.

Referring now to FIG. 5, the base 12 includes a pair of orifices 18 through which the first and second nozzles 116 and 118 extend outwardly and couple to (e.g., directly mate with) the corresponding first and second water outlets 112 and 114. The nozzles 116 and 118 preferably slide in and snap fit or are otherwise securely engage and fasten in water tight relation to the water outlets 112 and 114. The nozzles can be manually rotatable or fixedly secured to the corresponding water outlets. Each nozzle is preferably positioned to direct the stream of pressurized water emitted toward the pool surface so that debris raised will be drawn into a corresponding water inlet port 17 formed in the base 12, as discussed below in further detail.

Although the centrifugal pump is shown as being mounted directly to interior surface of the base 12 in a manner such that the outlets 112, 114 and nozzles 116, 118 can be directly connected, a person of ordinary skill in the art will appreciate that the nozzles can be positioned remotely from centrifugal pump 110 and tubing (not shown) can be provided to connect the water outlets 112, 114 to provide fluid communication streams of water to the nozzles 116, 118.

The power wash assembly 100 is preferably made of a polymeric material, such as polyvinylchloride (PVC), polypropylene, among other well-known thermoplastic materials, aluminum and/or alloys thereof, and/or combinations thereof, and/or other corrosion resistant, water impermeable materials.

Referring to FIG. 3, the motor assembly 78 is illustratively secured to the motor mount 79 which extends upwardly from the base 12. The centrifugal pump 110 is mounted directly to the upper surface of the base 12 below the motor assembly 78. A person of ordinary skill in the art will appreciate that the centrifugal pump can be mounted at other locations within the interior chamber of the cleaner. For example, the centrifugal pump can be mounted to the underside of the housing cover above the motor assembly 78.

Figure 8:
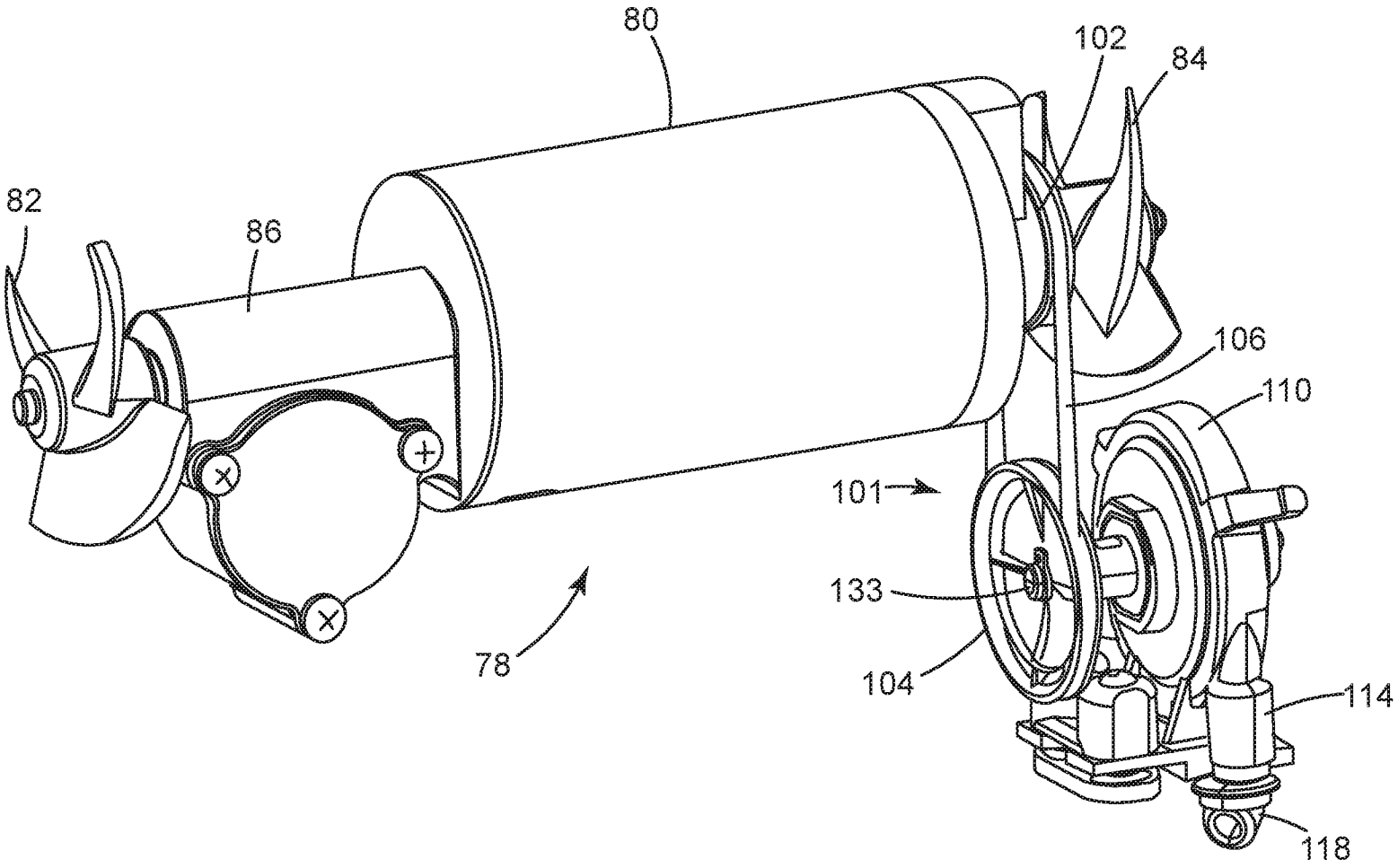
FIG. 8 is a right side isometric view of the dual propeller motor and the power wash assembly of FIG. 1.

Referring now to FIGS. 7-9, preferably, the centrifugal pump 110 is powered, i.e., rotated by the electric motor 80 via the transmission assembly 101. The transmission assembly 101 includes one or more gears and/or a combination of belts and pulleys that collectively transfer rotational power from the drive shaft of the electric motor assembly 78 and transfer the rotational forces of the electric motor 80 to the centrifugal pump 110. The dual propeller motor assembly 78 includes a drive shaft 81 having a first end where the gear box 86 and first impeller 82 are coupled, as described above with respect to the brush assembly 19. The second propeller 84 is coupled to the opposite second end of the drive shaft 81 of the electric motor 80.

The transmission assembly 101 includes a first centrifugal pump pulley 102 mounted between the rear of the second propeller 84 and the opposing end of the electric motor 80. The centrifugal pump 110 includes a second pump pulley 104 mounted to the second (rear) end of the impeller drive shaft 124. The second end of the impeller drive shaft 124 and the central opening in the pulley 104 are preferably keyed to prevent slippage therebetween. A retaining ring 133 (FIG. 8) is provided to further secure the second pulley 104 on the impeller shaft 124.

An O-ring can advantageously be used as the drive belt between the first and second centrifugal pump pulleys 102, 104 to transfer the rotational forces from the drive shaft of motor 80 to the centrifugal pump 110. A person of ordinary skill in the art will appreciate that a drive belt having internally directed teeth and mating pulleys or having a non-toothed interior surface can be positioned around the first and second pulleys 102, 104.

The rotational speed of the centrifugal pump 110 that is necessary to produce the water jets directed to the surface beneath the cleaner through the nozzles is generally less than the rotational speed of the electric motor 80. Accordingly, the transmission assembly 101 is provided with a rotation-reduction configuration to reduce the rotational rate (rpm's) of the centrifugal pump 110. Referring to FIGS. 7 and 8, the transmission assembly 101 implements the second centrifugal pump pulley 104 with a diameter that is greater than the diameter of the first centrifugal pump pulley 102 to thereby reduce the rotational rate of the centrifugal pump relative to the rotational rate of the drive shaft of electric motor 80. For example, the electric motor 80 illustratively rotates at a rate of 2500-3000 rotations per minute (rpm) and the transmission is configured to reduce the rotational rate of the centrifugal pump impeller 120 by at least 5%. A person of ordinary skill in the art will appreciate that different sized first and second pulleys 102 and 104 can be implemented to increase, decrease or maintain the rotational rate of the centrifugal pump impeller 120 with respect to the rotational rate of shaft of the electric motor 80.

Referring to FIG. 10, the impeller cover 111 includes a plurality of spaced apart slots 117 and serves as an intake manifold to permit the filtered water in the interior chamber 44 to flow into the centrifugal pump 110 in a direction along the central axis of the impeller 120. As the impeller 120 is rotated by the electric motor 80 and transmission assembly 101, the impeller blades 122 force the water in a direction normal to the central axis of the impeller and towards one of the outlets so that the filtered water is discharged as a pressurized water jet through the corresponding nozzle.

Figure 12:
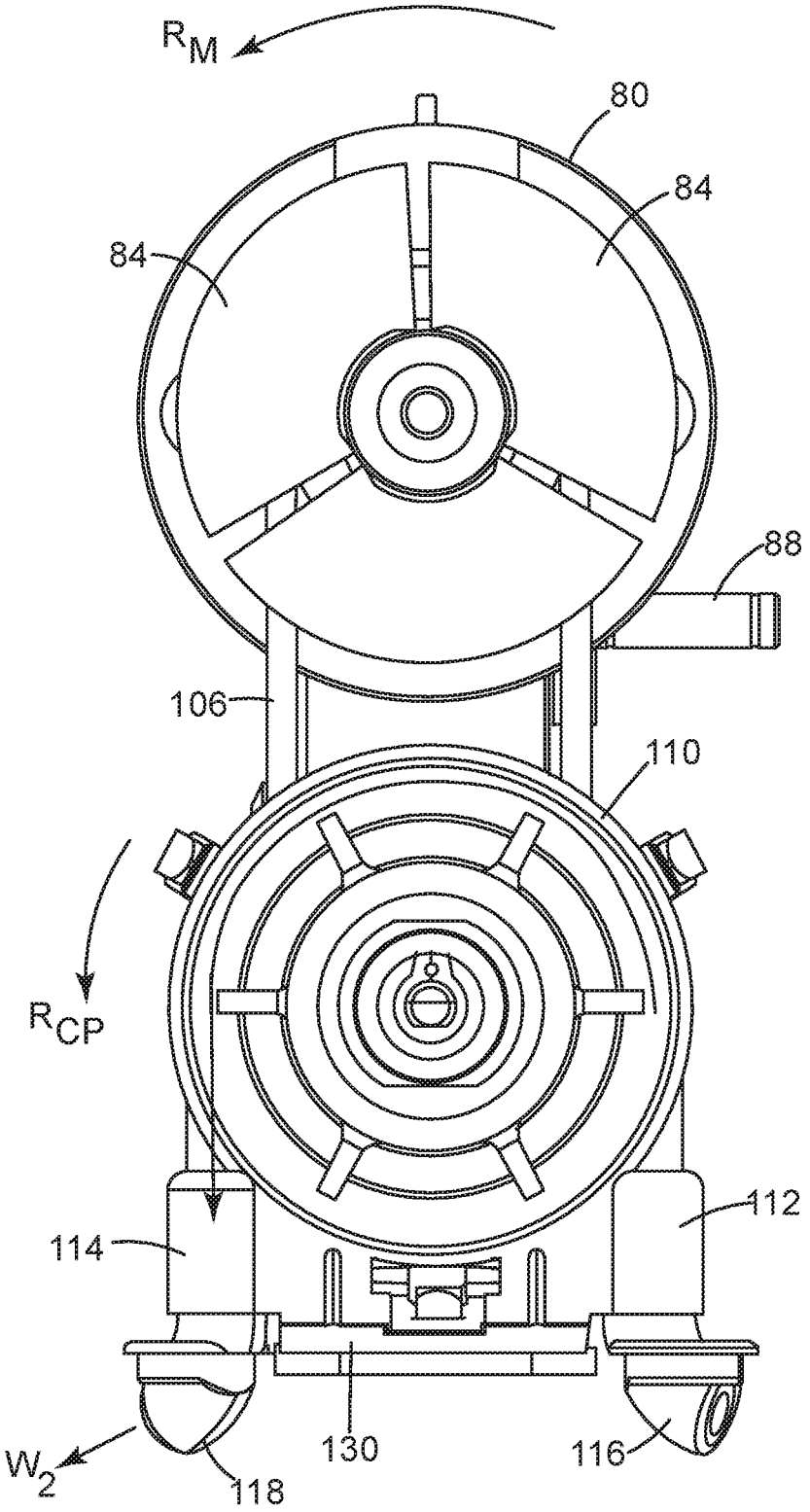
FIG. 12 is a front elevated view of the dual propeller motor and the power wash assembly of FIG. 1 illustrating a second water jet nozzle discharging a pressurized stream of water when the dual propeller motor is rotating in a counter-clockwise direction.
Figure 13:
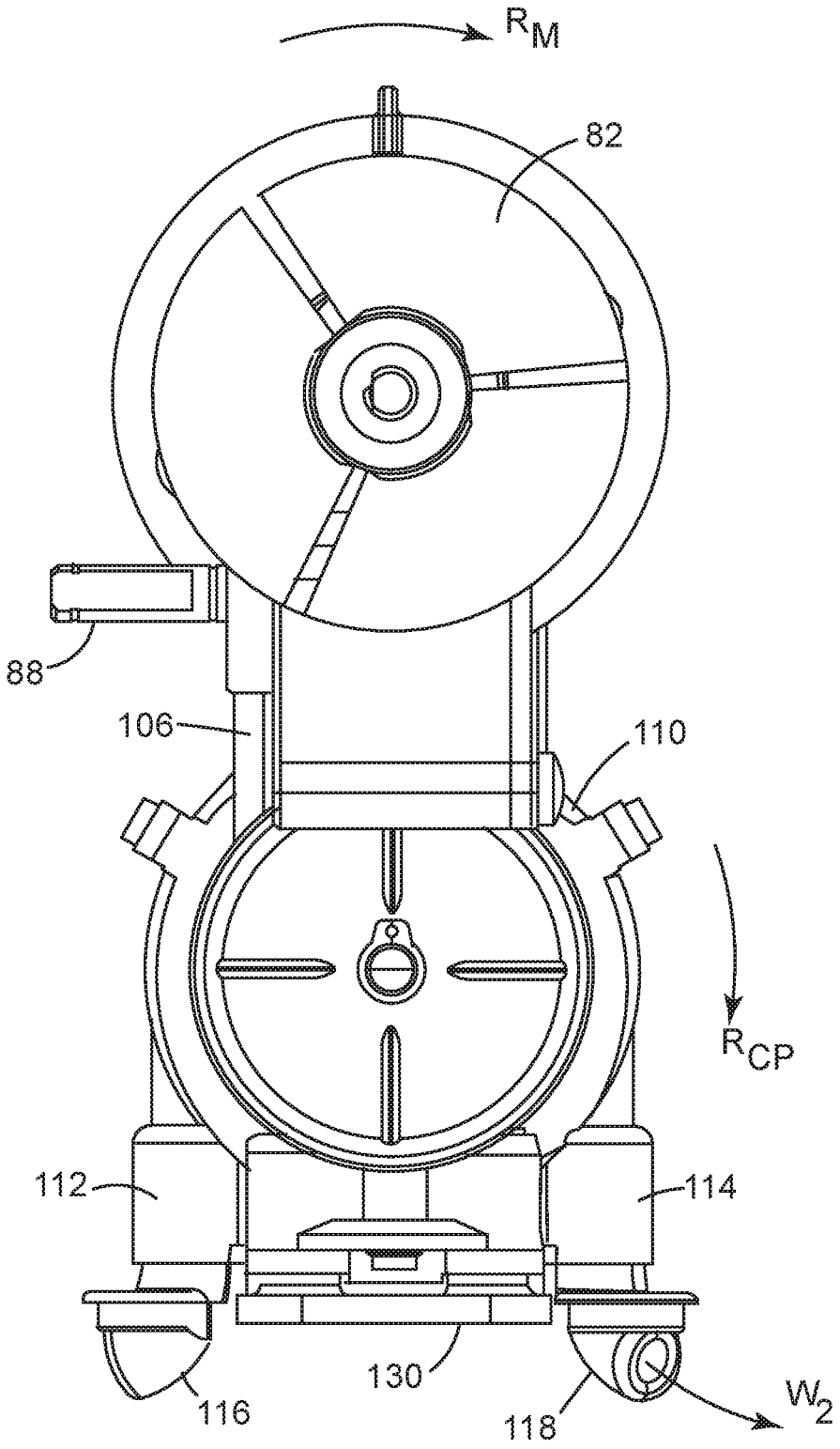
FIG. 13 is a rear elevated view of the dual propeller motor and the power wash assembly of FIG. 12 illustrating the second water jet nozzle discharging a pressurized stream of water when the dual propeller motor is rotating in the counter-clockwise direction.

Referring to FIG. 11, a front view of the centrifugal pump 110 and motor assembly 78 are illustratively shown with the impeller cover 111 removed from the centrifugal pump housing 113. The electric motor 80 and centrifugal pump are illustratively shown as rotating in a clockwise direction as indicated by the arrows "Rm" and "Rcp", respectively. As the impeller blades 122 of the centrifugal pump rotate clockwise, the water drawn into the pump through the slots 117 is forced through the first outlet 112 and the first nozzle 116 as shown by the arrow "W1". Conversely, when the centrifugal pump is rotated in a counter-clockwise direction, as illustratively shown in the front elevation view of FIG. 12 and rear elevation view of FIG. 13, the water drawn into the pump through the slots 117 is similarly forced through the second outlet 114 and second nozzle 118 as shown by the arrow "W2".

Referring now to FIG. 5, the first nozzle 116 is illustratively directed forward of the water inlet port 17 positioned proximate the right side brush well 15 and the passive roller brush (not shown). When the cleaner 10 is moving in a forward direction in this illustrative embodiment as indicated by arrow "F1", the electric motor 80 and centrifugal pump impeller 120 are preferably rotating in the clockwise direction to cause the discharge of a water jet "W1" from the first nozzle 116. At this time, the second nozzle 118 is inactive because it does not discharge a pressurized water jet. The pressurized water jet W1 lifts up and suspends the debris in the water ahead of the illustrative right side water inlet port 17. As the cleaner moves forward in the F1 direction and the low pressure environment is create by the dual propeller motor assembly 78 in the interior chamber 44, the water and suspended debris ahead of the right inlet port 17 is drawn into the cleaner for filtering and discharge through one of the discharge ports 70 as described above.

When the cleaner 10 approaches a side wall of the pool or otherwise reverses direction to move in a forward direction as indicated by arrow "F2", the electric motor 80 and centrifugal pump impeller 120 are reversed to rotate in a counter-clockwise direction to cause the discharge of a water jet "W2" from the second nozzle 118. At this time, the first nozzle 116 becomes inactive and no longer discharges the pressurized water jet W1. The pressurized water jet W2 lifts up and suspends the debris in the water rearward of the leading left side inlet port 17. As the cleaner moves forward in the F2 direction and the low pressure environment is created by the dual propeller motor assembly 78 in the interior chamber 44, the water and suspended debris rearward of the leading left inlet port 17 is drawn into the cleaner for filtering and discharge through one of the discharge ports 70. As noted above, the bottom surface of the base 12 preferably includes an upwardly sloped or curved portion 16 formed around each water inlet port 17 to help channel or otherwise direct the flow of water and debris beneath the cleaner into the water inlet port 17.

In one embodiment, the nozzles are directed or angled in a range of fifteen to twenty degrees towards the surface beneath the cleaner. However, such nozzle direction is not considered limiting as the nozzles can be set at other acute angles with respect to the surface beneath the cleaner.

While the foregoing is directed to embodiments of the present invention, other and further embodiments and advantages of the invention can be envisioned by those of ordinary skill in the art based on this description without departing from the basic scope of the invention, which is to be determined by the claims that follow.

What is claimed is:

1. A robotic pool cleaner for cleaning a surface of a pool comprising:

a housing including an upper portion disposed over a base to define an interior chamber therein, the base including at least one water inlet and the upper portion having at least one water discharge port;

a filter assembly for filtering water drawn through the at least one water inlet;

a first water pump comprising a drive shaft having a first end coupled to a propeller, the first water pump drawing water and debris from beneath the cleaner through the at least one inlet, the debris being retained by the filter assembly and the filtered water being discharged through the at least one water discharge port; and a power wash assembly including a transmission assembly for transferring rotational movement from the drive shaft of the first water pump to a drive shaft of a second water pump having an inlet in fluid communication with filtered water from the interior of the housing and an outlet in fluid communication with at least one nozzle positioned beneath the base which discharges filtered water in the form of a water jet to dislodge debris from the surface of the pool.

2. The pool cleaner of claim 1 wherein the transmission assembly comprises:

a first pulley coupled to the drive shaft of the first water pump;

a second pulley coupled to the drive shaft of the second water pump; and a drive belt wrapped around the first and second pulleys.

3. The pool cleaner of claim 2, wherein the drive belt is an O-ring.

4. The pool cleaner of claim 2, wherein the first and second pulleys have the same diameter.

5. The pool cleaner of claim 2, wherein the diameter of the first pulley is greater than the diameter of the second pulley.

6. The pool cleaner of claim 2, wherein the diameter of the first pulley is less than the diameter of the second pulley.

7. The pool cleaner of claim 2, wherein the second water pump comprises:

a circular pump housing having a central axis; and an impeller mounted to a rotatable impeller shaft which extends along the central axis of the pump housing.

8. The pool cleaner of claim 7, wherein the second pulley is coupled to the impeller shaft.

9. The pool cleaner of claim 8, wherein the second pulley is mounted on a first end of the impeller shaft and the impeller is mounted on a second opposing end of the impeller shaft.

10. The pool cleaner of claim 7, wherein the impeller comprises a plurality of linearly-shaped blades directed radially outward from the impeller shaft.

11. The pool cleaner of claim 1 wherein the second water pump is a centrifugal pump.

12. The pool cleaner of claim 1 wherein the at least one nozzle is directed toward the pool surface beneath the cleaner.

13. The pool cleaner of claim 1 further comprising rotatably-mounted supports supporting and guiding the cleaner along the pool surface.

* * * * *